US007089607B2

(12) United States Patent
Barnes et al.

(10) Patent No.: US 7,089,607 B2
(45) **Date of Patent: *Aug. 15, 2006**

(54) POOL DRAIN ASSEMBLY WITH ANNULAR INLET

(75) Inventors: Steven R. Barnes, Phoenix, AZ (US); John M. Goettl, Phoenix, AZ (US)

(73) Assignee: Paramount Leisure Industries, Inc., Tempe, AZ (US)

( * ) Notice: Subject to any disclaimer, the term of this patent is extended or adjusted under 35 U.S.C. 154(b) by 87 days.

This patent is subject to a terminal disclaimer.

(21) Appl. No.: 10/931,001

(22) Filed: Aug. 31, 2004

(65) Prior Publication Data

US 2005/0066435 A1 Mar. 31, 2005

Related U.S. Application Data

(63) Continuation of application No. 10/144,899, filed on May 14, 2002, now Pat. No. 6,810,537.

(51) Int. Cl.
*E04H 4/12* (2006.01)

(52) U.S. Cl. ..... 4/508; 4/507; 4/509; 137/362

(58) Field of Classification Search ..... 4/507, 4/295, 293, 508, 513, 510, 512, 671, 673, 4/681, 688, 692; 137/362
See application file for complete search history.

(56) References Cited

U.S. PATENT DOCUMENTS

| | | | | |
|---|---|---|---|---|
| 641,185 | A * | 1/1900 | Borein | 4/295 |
| 1,454,310 | A | 5/1923 | Booraem | 4/511 |
| 1,839,663 | A * | 1/1932 | Fehn | 4/688 |
| 3,813,708 | A * | 6/1974 | Hamburg | 4/295 |
| 3,940,807 | A | 3/1976 | Baker et al. | 4/172 |
| 4,115,878 | A | 9/1978 | Johnson et al. | 4/172.17 |
| 4,170,047 | A | 10/1979 | Corsette et al. | 4/293 |
| 4,503,573 | A | 3/1985 | Handzel | 4/507 |
| 4,602,391 | A | 7/1986 | Shepherd | 4/542 |
| 4,658,449 | A | 4/1987 | Martin | 4/496 |
| 4,936,338 | A * | 6/1990 | Fonoimoana | 4/287 |
| 5,268,096 | A | 12/1993 | Robol | 210/164 |

(Continued)

*Primary Examiner*—Khoa D. Huynh
(74) *Attorney, Agent, or Firm*—Cahill, von Hellens & Glazer P.L.C.

(57) ABSTRACT

The swimming pool floor or spa floor drain assembly of the present invention includes a drain body having a mouth positionable in proximity to the pool wall to serve as a fluid flow inlet, a spaced apart fluid flow outlet positionable below the mouth and a sidewall interconnecting the mouth with the outlet to define a fluid flow chamber. The cross sectional area of the fluid flow chamber decreases from the mouth to the base. A fluid deflecting plug includes a comparatively large area top and a comparatively small area base. A sidewall interconnects the top and base to form the plug with a cross sectional area decreasing from the top to the base. A support structure positions the plug within the drain body such that at least a substantial portion of the plug sidewall is spaced apart from the drain body sidewall to define a fluid flow channel having a first comparatively larger cross sectional area in proximity to the drain body mouth and a second comparatively smaller cross sectional area in proximity to the drain body outlet. The variation in the cross sectional area from the drain body mouth to the drain body outlet provides a lower fluid flow velocity at the mouth than at the outlet when fluid is transferred from the pool through the floor drain assembly.

28 Claims, 9 Drawing Sheets

U.S. PATENT DOCUMENTS

| | | | | |
|---|---|---|---|---|
| D343,228 | S | 1/1994 | Colin | 4/488 |
| 5,341,523 | A | 8/1994 | Barnes | 4/507 |
| 5,408,706 | A | 4/1995 | Barnes | 4/507 |
| 5,734,999 | A | 4/1998 | Nicholas | 4/507 |
| 5,753,112 | A | 5/1998 | Barnes | 210/169 |
| 5,759,414 | A | 6/1998 | Wilkes et al. | 210/774 |
| 5,819,328 | A * | 10/1998 | Lewis | 4/295 |
| 5,822,807 | A | 10/1998 | Gallagher et al. | 4/507 |
| 5,878,773 | A | 3/1999 | Robol | 137/112 |
| 5,978,981 | A | 11/1999 | Nelson | 4/541.1 |
| 6,038,712 | A | 3/2000 | Chalberg et al. | 4/507 |
| 6,085,779 | A * | 7/2000 | Eriksson | 137/362 |
| 6,088,842 | A | 7/2000 | Barnett | 4/286 |
| 6,098,654 | A | 8/2000 | Cohen et al. | 137/467 |
| 6,170,095 | B1 | 1/2001 | Zars | 4/507 |
| 6,230,337 | B1 | 5/2001 | Barnett | 4/507 |
| 6,341,387 | B1 | 1/2002 | Zars | 4/504 |

* cited by examiner

POOL DRAIN ASSEMBLY WITH ANNULAR INLET

CROSS REFERENCE TO RELATED APPLICATIONS

The present application is a continuation of and claims priority to an application entitled POOL FLOOR DRAIN ASSEMBLY FOR A SUCTION-ACTIVATED WATER CIRCULATION SYSTEM, filed May 14, 2002, assigned Ser. No. 10/144,899 now U.S. No. 6,810,537, which application is directed to an invention made by the present inventors and assigned to the present assignee.

BACKGROUND OF THE INVENTION

1. Field of the Invention

The present invention relates to swimming pool and spa floor drain assemblies, and more particularly to pool floor drain assemblies having an outlet coupled to a water return line which transfers water from a pool or spa to a pump.

2. Description of the Prior Art

U.S. Pat. No. 3,940,807 (Baker) discloses a safety suction outlet for pools and utilizes radially extending tubes to inhibit drain flow blockage.

U.S. Pat. No. 4,115,878 (Johnson) discloses a spa safety drain having a conventional grating or cover protecting a chamber which includes a secondary bypass feature.

U.S. Pat. No. 4,658,449 (Martin) discloses a protective adaptor for a pool drain designed to be placed above a pool floor drain grating to define a raised screening surface for screening any water flowing into the drain to prevent whirlpooling effect in the drain.

U.S. Pat. No. 5,268,096 (Robol) discloses a typical cavity style prior art pool floor drain having a perforated grating or cover, an underlying cylindrical chamber and a horizontally oriented suction line.

U.S. Pat. No. 5,341,523 (Barnes) discloses an anti-vortex drain which avoids the requirement for a grating by providing a circular cover in combination with a spaced apart circular lip placed above a cylindrical sump chamber having a horizontal suction line.

U.S. Pat. No. 5,734,999 (Nicholas) discloses a safety device for swimming pools which includes a floor drain grate having two or more water inlet systems one of which is spaced widely apart from the primary drain to reduce the probability of that a bather will block the floor drain assembly.

U.S. Pat. No. 5,753,112 (Barnes) discloses a main drain leaf removal system for swimming pools which includes a cylindrical inner chamber with an inlet port elevated above the swimming pool floor and a larger diameter concentrically disposed cylindrical outer chamber having an inlet system level with the pool floor. Separate suction pipes transfer water from the inner and outer chambers. The outer chamber is designed to serve as a leaf removal chamber.

U.S. Pat. No. 5,759,414 (Wilkes) discloses a swimming pool main drain assembly having a domed top including both water inlets as well as a centrally located water outlet.

U.S. Pat. No. 6,038,712 (Chalberg) discloses a safety suction assembly for use in whirlpool baths which includes a safety relief vent located in the center of the drain cover which is activated when the drain is blocked.

U.S. Pat. No. 6,088,842 (Barnett) discloses a drain assembly for preventing hair entanglement in a pool or hot tub and illustrates a slotted grate as well as other grate configurations all having tapered lower grate surfaces.

U.S. Pat. No. 6,230,337 (Barnett) discloses an anti-vacuum drain cover having an elevated grating as well as spoke-like water inlets located at the pool floor level, the openings of which are spaced apart from the central point of the pool floor drain.

SUMMARY OF THE INVENTION

Briefly stated, and in accord with one embodiment of the invention, a floor drain assembly for installation in the wall of a swimming pool or spa includes a drain body, a fluid deflecting plug and a support structure. The drain body includes a mouth positionable in proximity to the pool wall and serves as a fluid flow inlet. A spaced apart fluid flow outlet is positionable below the mouth of the drain body. The drain body further includes a sidewall which interconnects the mouth with the outlet to define a fluid flow chamber. The cross sectional area of the fluid flow chamber decreases from the mouth to the base. The fluid deflecting plug includes a comparatively large area top and a comparatively small area base. A sidewall interconnects the top and base to form the plug with a cross sectional area which deceases from the top to the base. The support structure positions the plug within the drain body such that at least a substantial portion of the sidewall is spaced apart from the drain body sidewall to define a fluid flow channel having a first comparatively larger cross sectional area in proximity to the drain body mouth and a second comparatively smaller cross sectional area in proximity to the drain body outlet. The variation in cross sectional area from the top portion to the bottom portion of the fluid flow channel provides a lower fluid flow velocity at the mouth than at the outlet when fluid is transferred from the pool through the floor drain assembly.

The pool floor drain of the present invention is adapted to receive, to compress and to transfer to the pump filter basket large, flexible debris such as leaves while simultaneously preventing accidental suction created mechanical entrapment of bathers. The pool floor drain assembly is provided with a structural configuration which functions to isolate the hydrostatic relief valve from the pool suction source. A secondary water circulation path is activated when the primary water circulation path becomes blocked. The floor drain assembly includes a separately removable access cover for accessing and servicing an optional hydrostatic pressure relief valve without impairing the safety features or operational characteristics of the drain even when the access cover has been removed. The floor drain inlet is joined with an elongated entrance path or channel formed with a sufficient length and with an appropriately tapered cross sectional configuration to minimize the possibility of mechanical entrapment of a bather's hand or fingers. The floor drain assembly may be configured as a dual drain system having at least two spaced apart suction inlets where high volume water circulation normally takes place through a primary suction inlet of a primary floor drain with substantially no flow volume through the suction inlet of a spaced apart secondary drain placed in either the pool wall or the pool floor unless the primary inlet has been at least partially blocked.

DESCRIPTION OF THE DRAWINGS

The invention is pointed out with particularity in the appended claims. However, other objects and advantages together with the operation of the invention may be better understood by reference to the following detailed description taken in connection with the following illustrations, wherein:

DESCRIPTION OF THE PREFERRED EMBODIMENT

In order to better illustrate the advantages of the invention and its contributions to the art, a preferred embodiment of the invention will now be described in detail.

Figure 10:
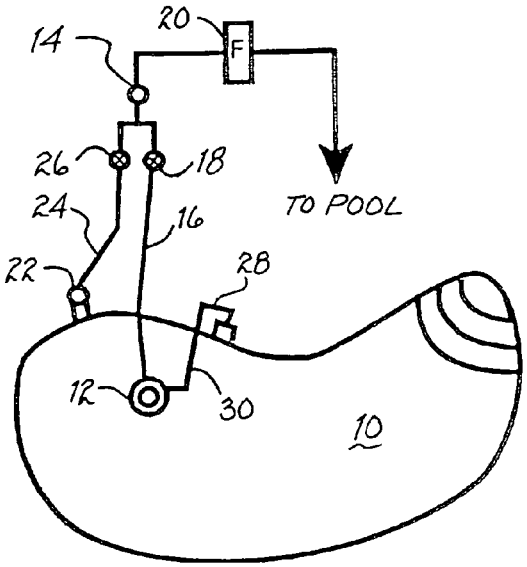
FIG. 10 represents a generalized schematic diagram illustrating how the pool floor drain assembly of the present invention may be installed.
Figure 11:
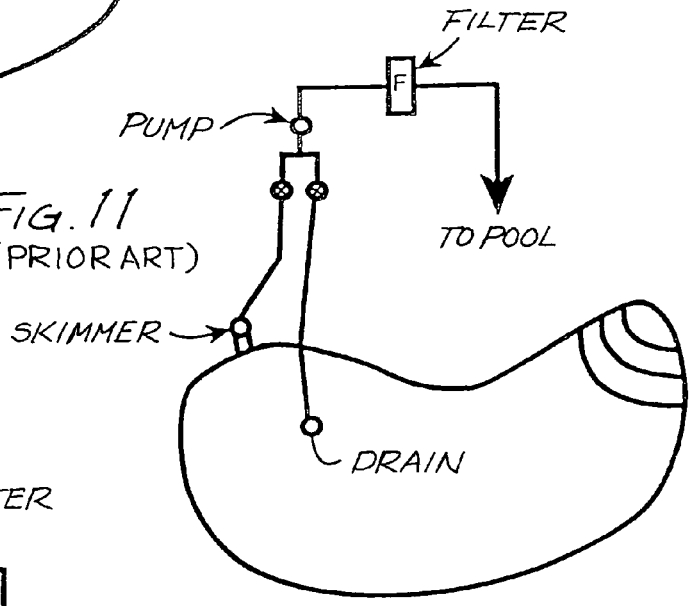
FIG. 11 (PRIOR ART)
FIG. 11 represents a schematic diagram of a pool using a prior art pool floor drain assembly.

FIG. 10 represents a generalized schematic diagram illustrating a swimming pool 10 including a swimming pool floor drain assembly 12 connected to pump 14 by pool suction or water return line 16 and valve 18. Pump 14 typically includes a pump filter basket. After passing through the pool filtration system 20, the filtered water is returned to pool 10. Skimmer 22 is connected by suction line 24 and valve 26 to pump 14. A secondary drain 28 or vacuum relief drain is interconnected with pool floor drain assembly 12 by alternate water return line 30. Vacuum relief drain 28 is preferably installed on a pool sidewall but may just as well be installed in the pool floor at a predetermined minimum distance away from the main pool floor drain assembly 12. Since the system of the present invention may also be installed in a spa the terms "pool" and "spa" will be used interchangeably.

Referring now to FIGS. 1–4, one preferred embodiment of the pool floor drain assembly 12 of the present invention will be described in detail. A drain sump 32 includes a bottom 34, a substantially cylindrical side surface 36 and an open top. A wedge shaped sealing lip 38 is positioned slightly inboard of the circular perimeter surface 40 of drain sump 32.

The bottom 34 of drain sump 32 includes an elongated, vertically oriented passageway 42. The FIG. 6 assembly drawing more clearly illustrates the individual component parts which are assembled and combined with the primary molded structural element 44 from which the complete drain sump 32 is fabricated. Using conventional molding techniques, drain sump 32 cannot be economically molded as a single integrated plastic part. To further facilitate molding, inlet 50 can be fabricated as a separate part and interconnected with the drain sump 32.

Figure 4:
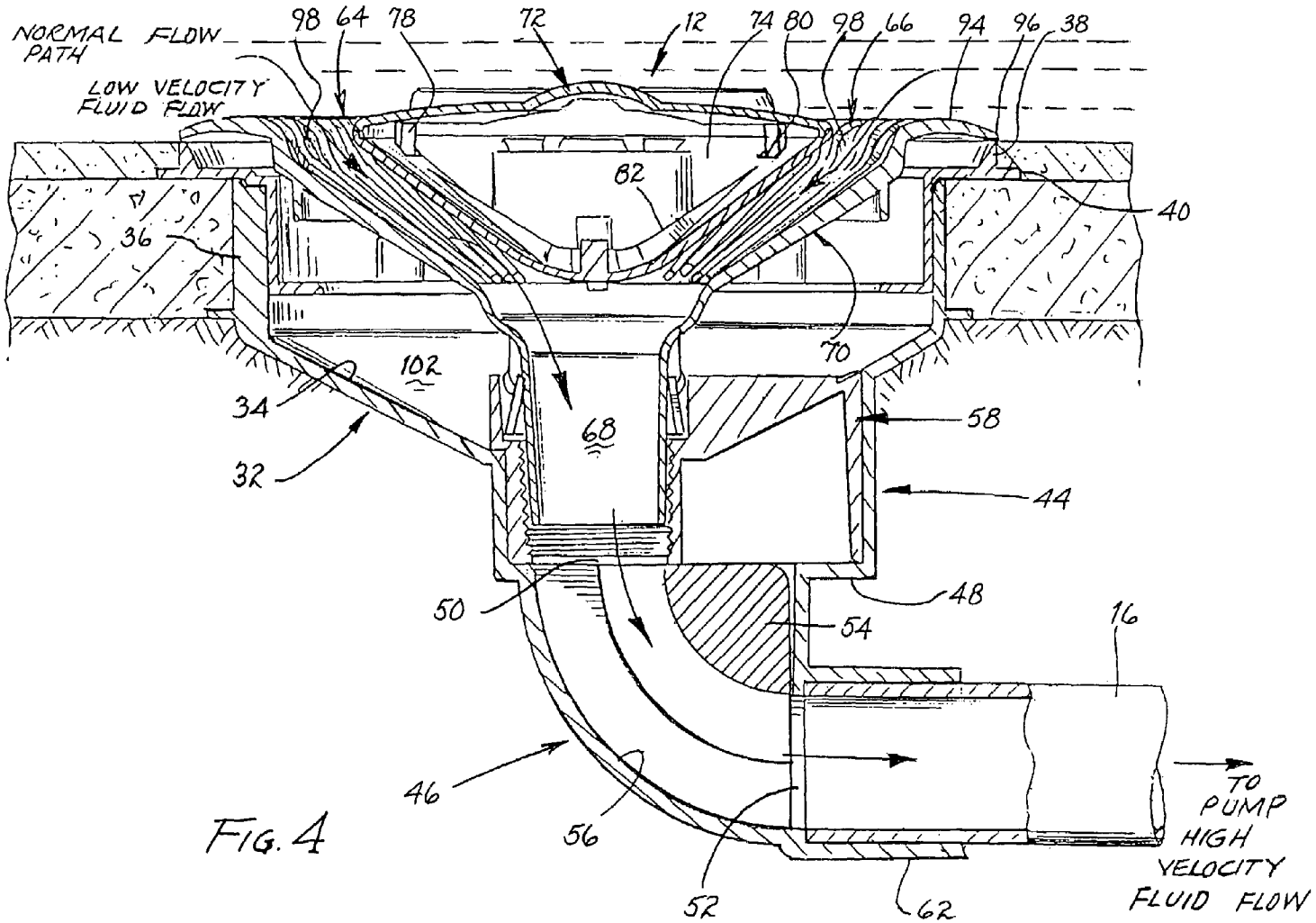
FIG. 4 represents a sectional view of the pool floor drain assembly illustrated in FIG. 1.
Figure 5:
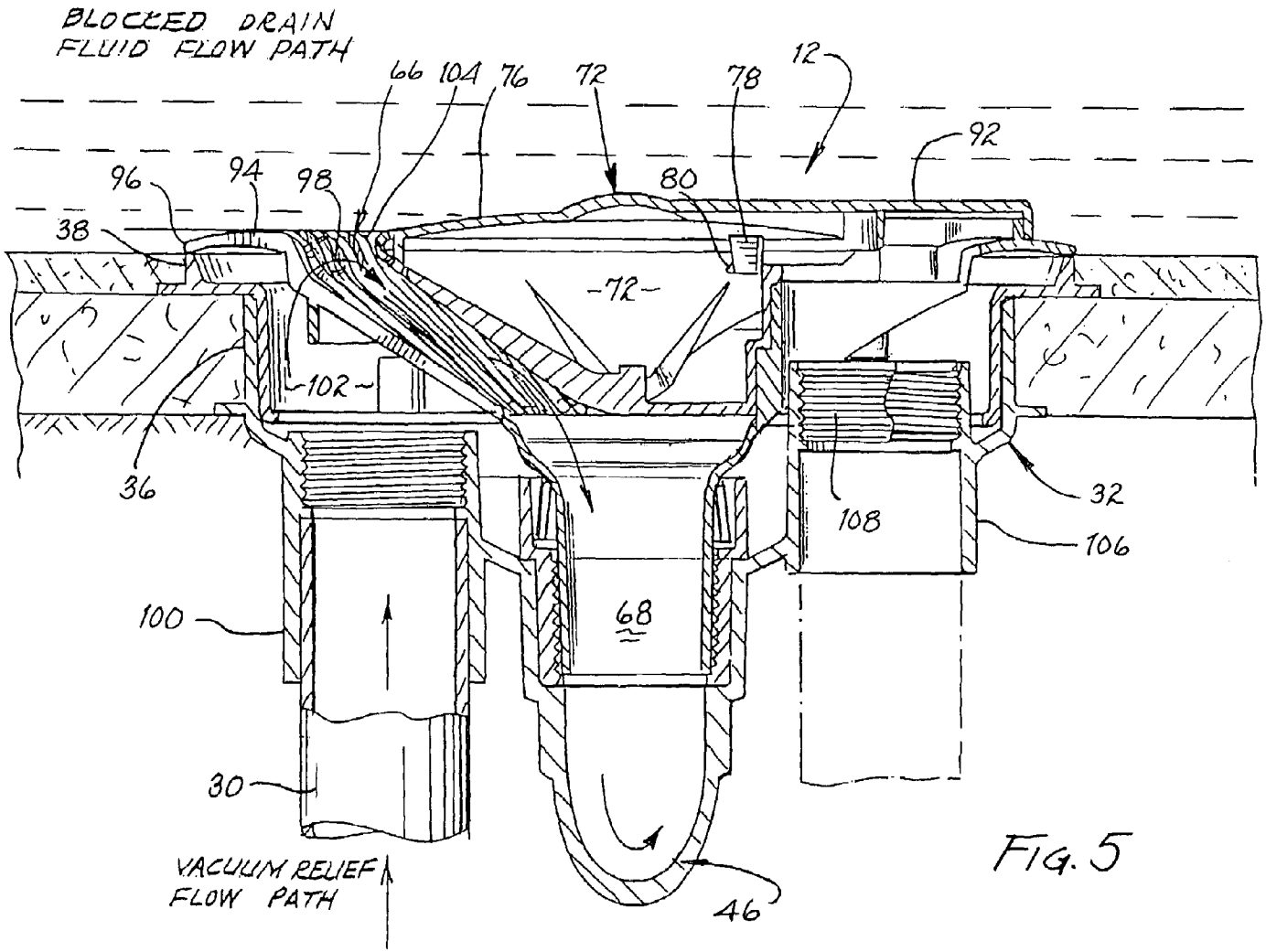
FIG. 5 represents a sectional view of the pool floor drain assembly illustrated in FIG. 1 taken from an angle different from that shown in FIG. 4.
Figure 6:
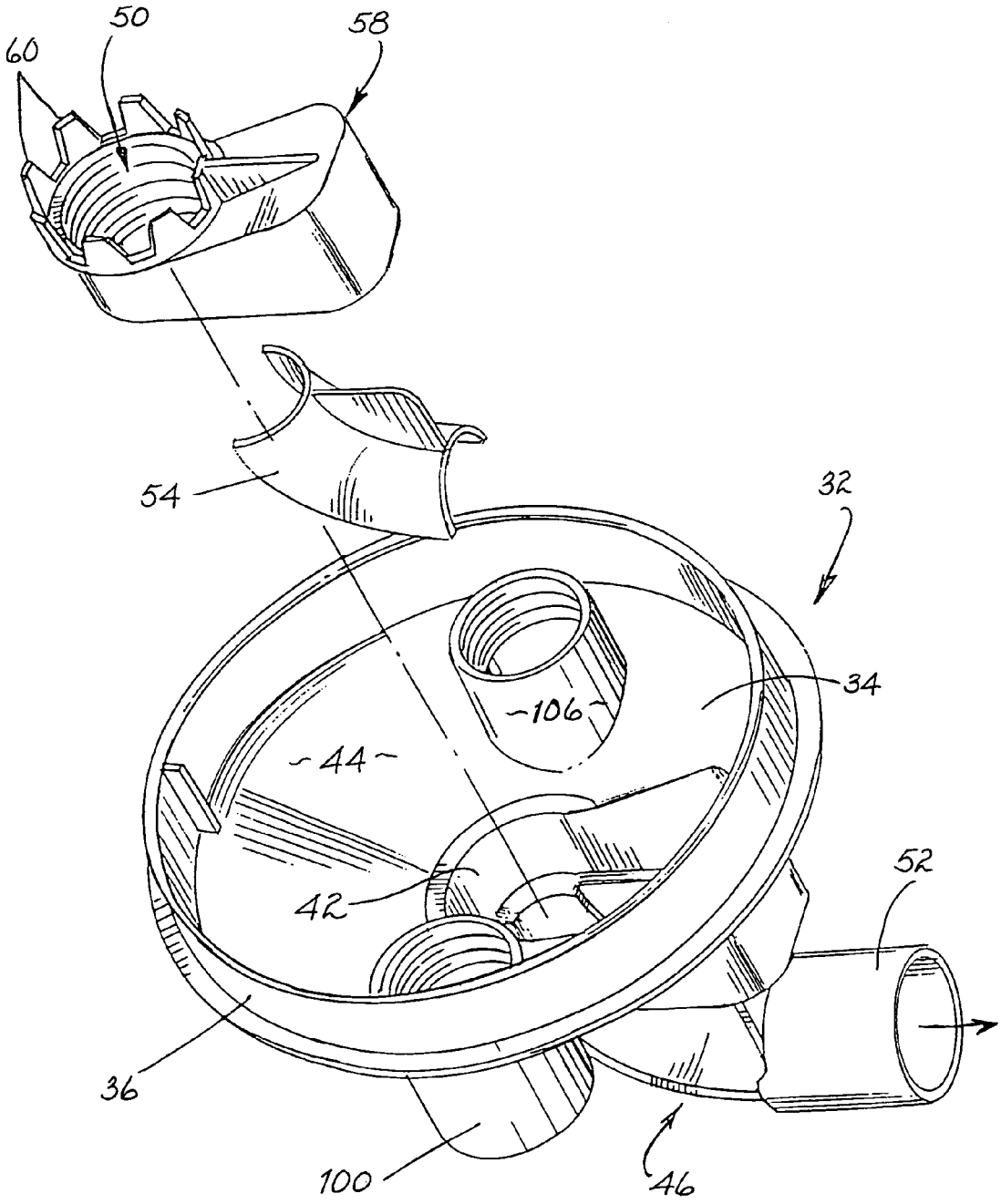
FIG. 6 represents an exploded perspective view of various elements of the pool floor drain assembly illustrated in FIG. 1.

As illustrated by FIGS. 4, 5 and 6, a vertical to horizontal fluid flow transition element 46 extends below the base 48 of drain sump 32 and includes a vertically oriented inlet 50 and a horizontally oriented outlet 52. As illustrated in the FIG. 6 assembly drawing, the inner portion 54 of fluid flow transition element 46 is individually molded and positioned adjacent to the outer portion 56 of fluid flow transition element 46 which is integrally molded with drain sump 32 to create the molded structural element 44 illustrated in FIGS. 4 and 6. Inner element 54 is typically placed into position during the assembly process without a glued together joint. Adapter element 58 is next placed into position and glued to molded structural element 44 as illustrated in the drawings. Adapter element 58 may include a plurality of radially spaced apart fingers 60. The interior surface of vertically oriented inlet 50 of adapter element 58 includes conventional female pipe threads.

Figure 9:
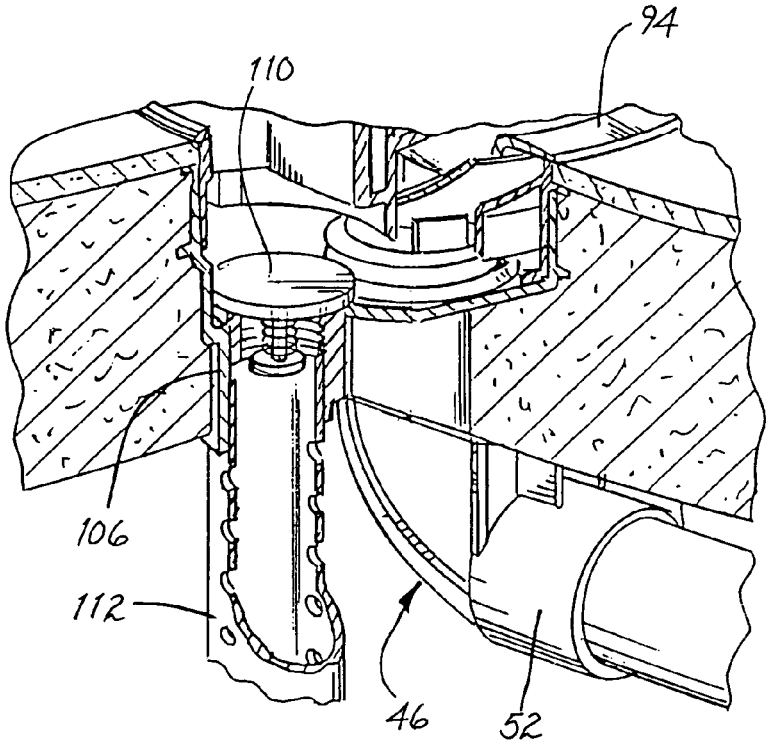
FIG. 9 represents a partially cutaway perspective view of the floor drain assembly of the present invention installed in a pool and including a hydrostatic pressure relief valve.

As shown in FIGS. 4 and 9, the horizontally oriented outlet 52 of fluid flow transition element 46 includes a female receptacle 62 which facilitates coupling to the suction or water return line 16. FIG. 4 illustrates that fluid flow transition element 46 includes an internal passageway having a cylindrical cross section with a substantially constant diameter.

Figure 8:
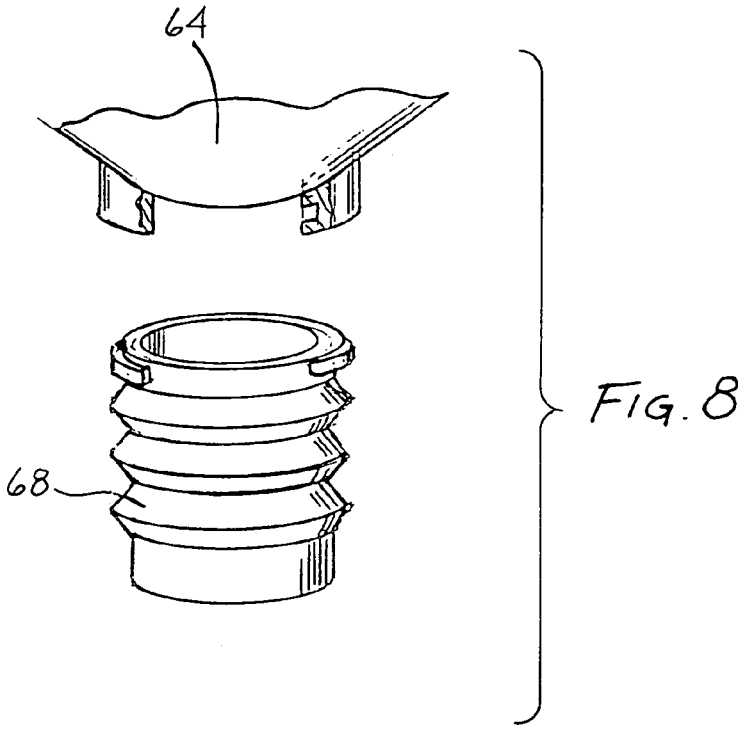
FIG. 8 represents a partially cutaway, exploded perspective view of the bayonet-mount coupling of the outlet portion of the drain body.

Referring now to FIGS. 1–5, the swimming pool floor drain assembly 12 of the present invention further includes a funnel shaped drain body 64 having a substantially circular mouth 66 which serves as a fluid flow inlet, a neck region 68 serving as a fluid flow outlet and a sidewall 70 interconnecting mouth 66 with neck 68. As best illustrated in FIG. 4, neck 68 is dimensioned to fit within and form a fluid tight coupling with inlet 50. As shown in FIG. 8, neck 68 may be formed as a separate element and connected to the remainder of drain body 64 by a twist lock bayonet mount. The lower portion of the neck 68 of funnel shaped drain body 64 is dimensioned to interfit with and form a relatively fluid tight seal with the female threaded portion of inlet 50 of adaptor element 58.

Figure 7:
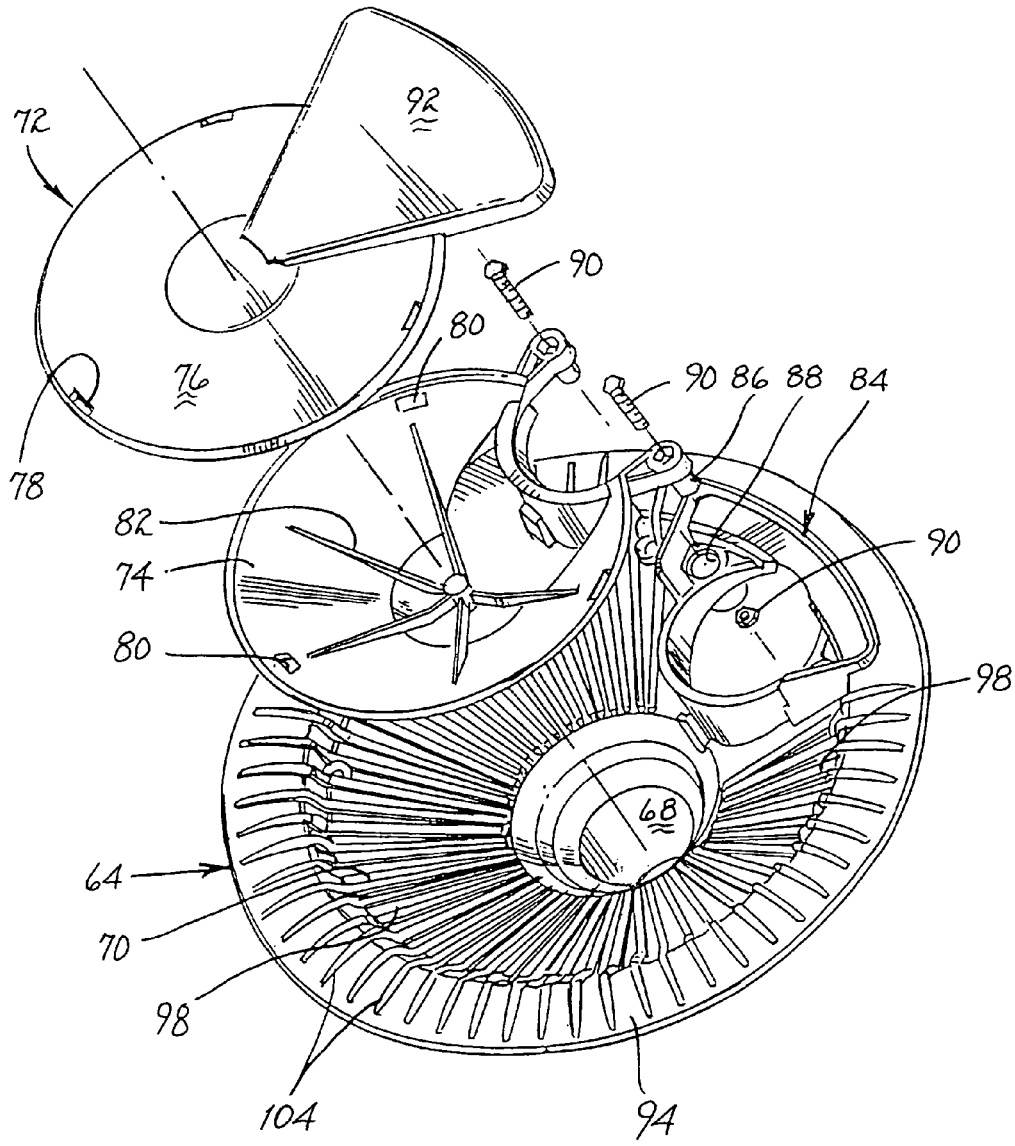
FIG. 7 represents an exploded perspective view of additional components of the pool floor drain assembly illustrated in FIG. 1.

The swimming pool floor drain assembly 12 of the present invention also includes a fluid deflecting plug 72 in the form of a conical member which includes a V-shaped sidewall 74 dimensioned to fit within mouth 66 of funnel shaped drain body 64 as best illustrated in FIGS. 1–4. The bottom of the V-shaped sidewall 74 defines a closed lower end surface of the plug 72. Fluid deflecting plug 72 further includes a domed top 76 closing the upper end surface of the plug 72. As illustrated in FIG. 7, domed top 76 includes a plurality of three spaced apart, downwardly extending clips 78 which pass through and form a snap together fit with three matching slots 80 in sidewall 74 of plug 72. These elements may also be interconnected by screws. A plurality of vertically extending reinforcing ribs 82 may be formed on the interior surface of sidewall 74 to enhance the structural strength of plug 72.

As illustrated in FIG. 4, the outer portion of the top of funnel shaped drain body 64 includes a laterally extending lip 94 having a circular perimeter area 96 which overlaps with, contacts and forms a relatively fluid tight seal with the mated, upwardly projecting wedge shaped sealing lip 38 of drain sump 32. During the original installation process, funnel shaped drain body 64 may be screwed into vertically oriented inlet 50 of adapter element 58 until a relatively fluid tight seal is formed between the perimeter area 96 of funnel shaped drain body 64 and the wedge shaped sealing lip of drain sump 32.

Figure 3:
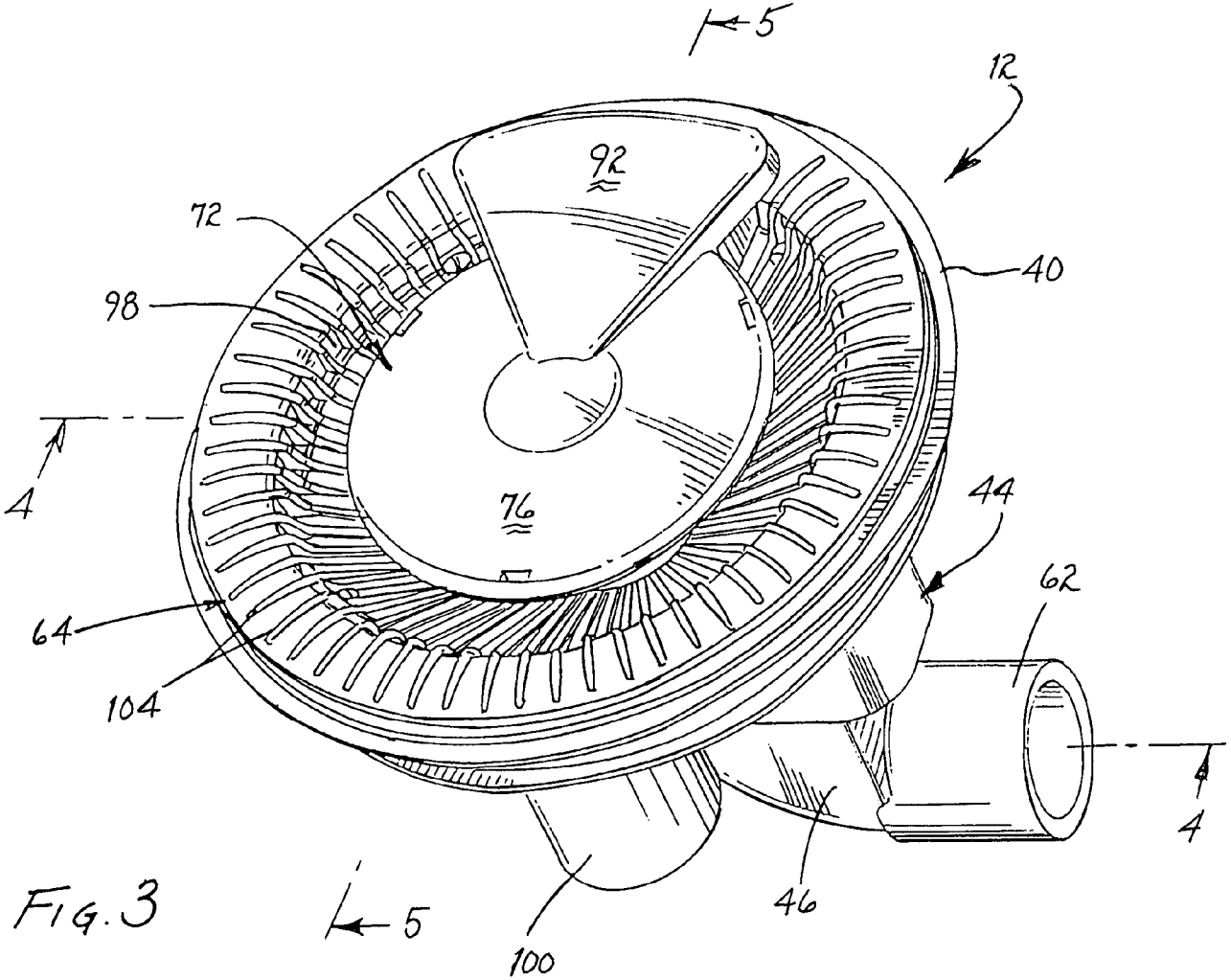
FIG. 3 illustrates a perspective view of a preferred embodiment of the pool floor drain of the present invention.

As best illustrated in FIGS. 3 and 7, a multi element support structure is generally illustrated by reference number 84 and serves as a rigid mechanical connection to secure fluid deflecting plug 72 within the interior of the funnel shaped drain body 64 and to maintain a fixed spacing between the sidewall 70 of funnel shaped drain body 64 and the sidewall 74 of fluid deflecting plug 72. The fixed spacing between sidewalls 70 and 74 defines a variable velocity fluid flow channel which extends from funnel mouth 66 to the funnel outlet or neck 68. The channel has a first cross sectional area in proximity to the funnel shaped drain body inlet and a second smaller cross sectional area in proximity to the funnel shaped drain body outlet to provide a reduced fluid flow velocity at the funnel shaped drain body inlet in comparison to the fluid flow velocity at the funnel shaped drain body outlet.

Support structure 84 may be configured as shown in FIG. 7 to include one or more plug like vertical support elements or pegs 86 which interface with a complementary shaped drain body lateral support element such as one or more spaced apart recesses 88 which perform the function of rigidly coupling plug 72 to drain body 64. While these components may be permanently glued together, they may also be removably coupled together by removable coupling means such as stainless steel nuts and bolts 90 as illustrated in FIG. 7. The extended or fanned out portion 92 of domed top 76 serves the cosmetic function of covering support structure 84 after the pool floor drain assembly has been installed in the floor of the swimming pool.

Figure 1:
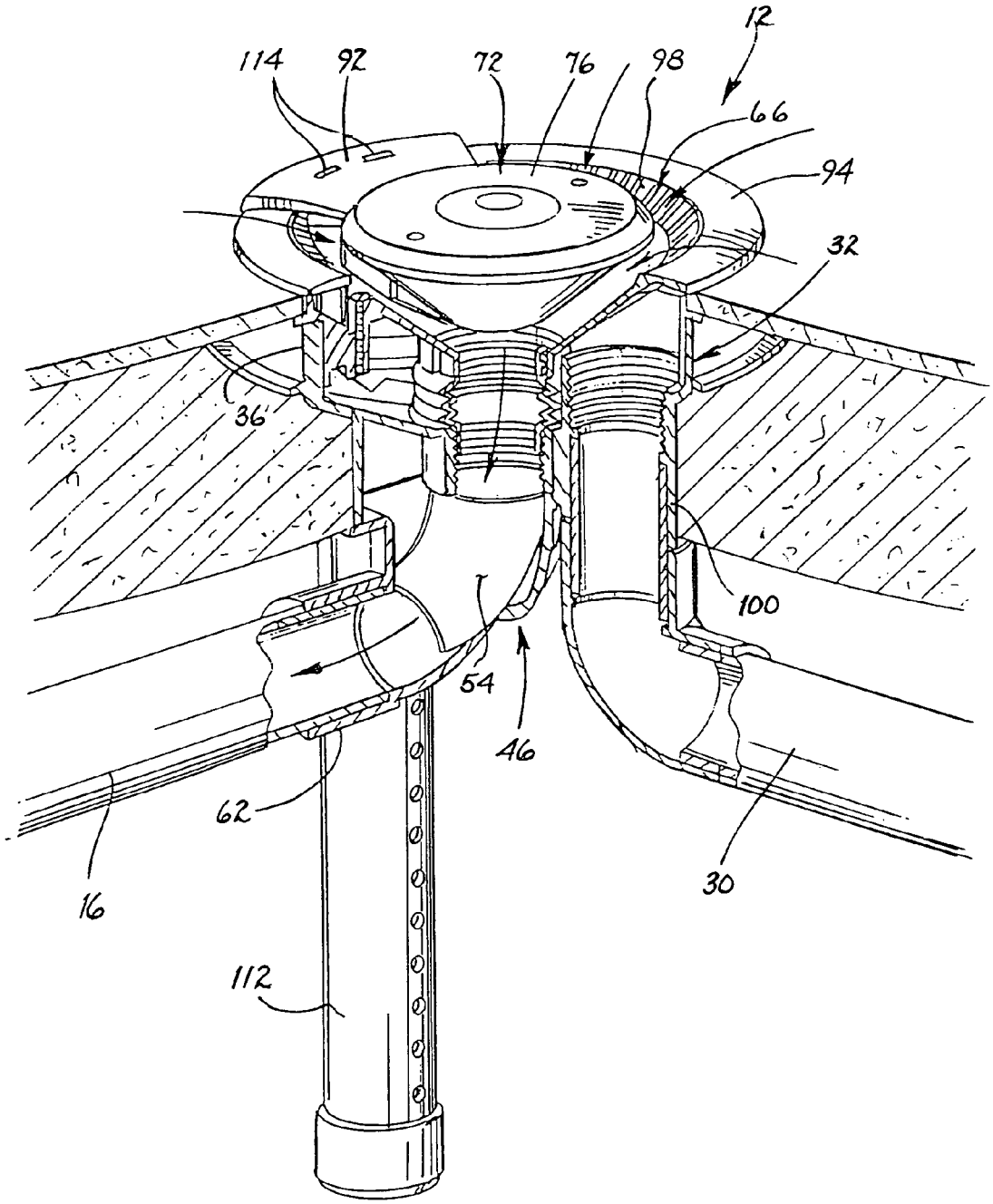
FIG. 1 illustrates a perspective view of a preferred embodiment of the floor drain assembly with arrows illustrating the normal water flow when the drain body inlet remains unobstructed.

Various additional structural elements may be added to the basic embodiment of the pool floor drain assembly 12 to enable it to be coupled as illustrated in FIG. 10 by water return line 30 to the secondary or vacuum relief drain 28. This alternate or secondary fluid flow path is activated only when fluid flow through the inlet or mouth 66 of floor drain assembly 12 is interrupted, either partially or completely, by an obstruction such as a bather sitting or lying across mouth area 66 which either completely or partially blocks the normal fluid flow path as illustrated in FIGS. 1 and 3.

Figure 2:
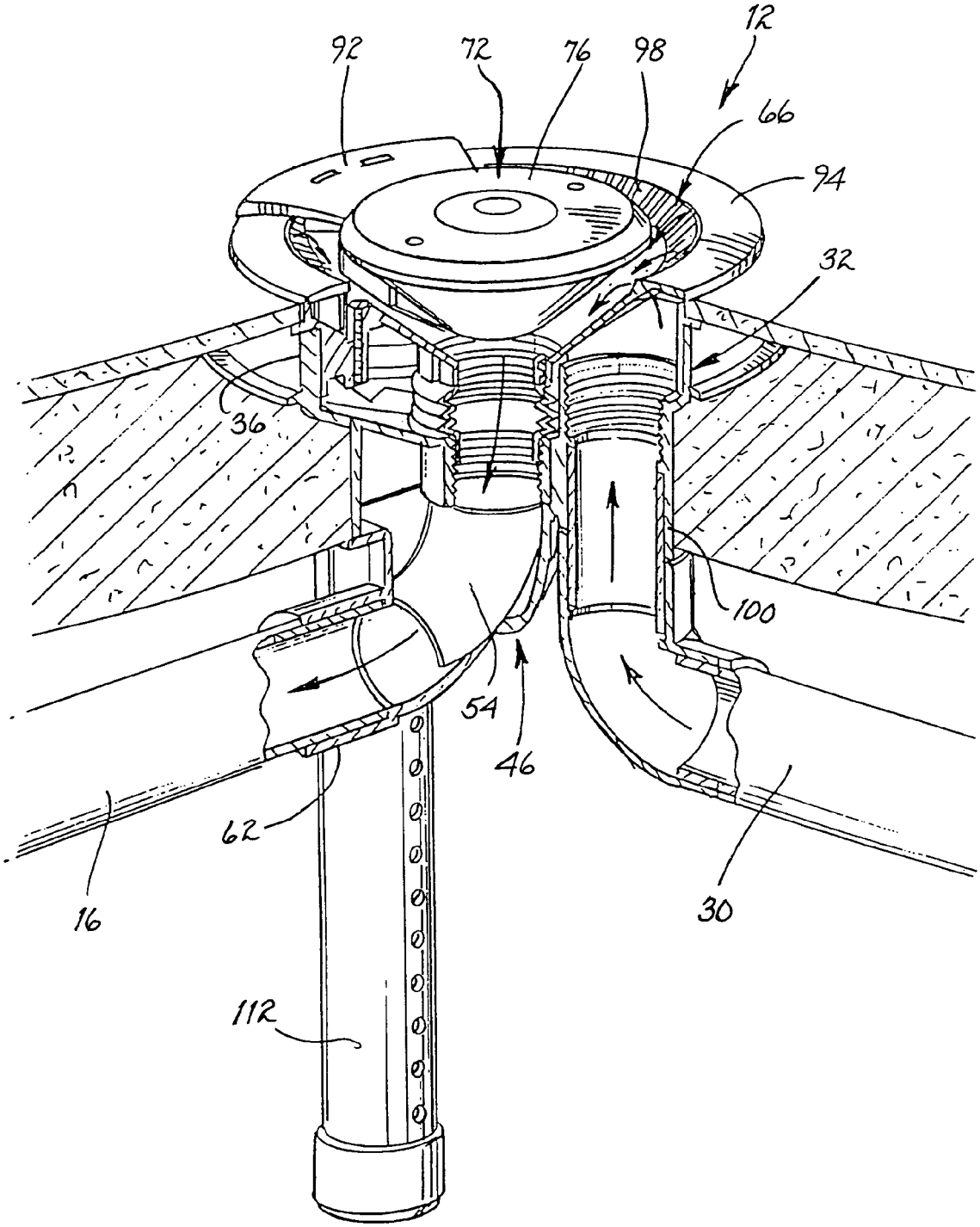
FIG. 2 illustrates the floor drain assembly of FIG. 1 with arrows showing a secondary water flow path which is activated when the primary inlet is at least partially obstructed.

The plurality of flow direction arrows depicted in the FIGS. 2 and 5 sectional views illustrate the alternate or secondary fluid flow path which is automatically activated when it becomes necessary to initiate fluid flow through vacuum relief drain 28 and alternate water return line 30. To facilitate this alternate or bypass water flow path, a plurality of laterally spaced apart, rectangular vacuum relief slots or fluid flow bypass apertures are formed in the sidewall 70 of funnel shaped drain body 64 just below the lip 94. Representative ones of these bypass slots or apertures are designated by reference number 98. As illustrated in FIGS. 3, 5 and 6, the bottom portion 34 of drain sump 32 includes a secondary fluid flow inlet 100 forming a water tight coupling with alternate return line 30.

As illustrated in FIGS. 1, 2, 4 and 5, a fluid distribution chamber or secondary chamber 102 is formed between and extends radially or coaxially around at least a portion of the funnel shaped drain body sidewall 70 and the interior of drain sump 32. Fluid distribution chamber 102 allows fluid to be transferred from secondary fluid flow inlet 100 through the plurality of fluid flow bypass slots 98 into the annular fluid flow channel formed between the sidewalls of funnel shaped drain body 64 and fluid deflecting plug 72. As illustrated by the fluid flow designating arrows in the FIGS. 2 and 5 drawings, in the bypass mode the flow of fluid continues downward through that channel, passes through the neck 68 of drain body 64, downward through fluid flow transition 46 and through water return line 16 to pump 14. The division of the fluid flow volume through the normal or primary flow path illustrated in FIG. 3 versus the alternate or secondary vacuum relief flow path illustrated in FIGS. 2 and 5 is determined by the degree of blockage or obstruction of the normal fluid flow path and the resulting internal pressure changes within the fluid flow channel between funnel shaped drain body 64 and fluid deflecting plug 72.

A plurality of ribs 104 projecting upward from the sidewall of funnel shaped drain body 64 may be provided to serve a number of different functions. First, ribs 104 will typically be located between adjacent fluid flow bypass slots 98 to maintain essentially laminar flow between the mouth 66 and neck 68 of funnel shaped drain body 64. Ribs 104 inherently provide enhanced structural rigidity which may be desirable in certain applications. The ribs are not necessary to the function of the present invention.

As illustrated in FIGS. 1–5, the fluid flow bypass slots 98 have been located toward the top of the fluid flow channel between funnel shaped drain body 64 and fluid deflecting plug 72 and in proximity to the mouth 66 of drain body 64. Although fluid flow bypass slots 98 could be located anywhere along this internal fluid flow channel, placing them toward the top of the fluid flow channel optimizes the performance of the pool floor drain assembly of the present invention. For example, when leaves or other relatively large size debris are sucked through the mouth of floor drain assembly 12, the laminar fluid flow within the drain assembly rapidly moves such debris downward through the unobstructed fluid flow channel without requiring that the leaves or other debris be deformed or folded, a process which will ultimately take place when such large debris enters into and then passes through the substantially reduced diameter neck region 68 of funnel shaped drain body 64.

The unique configuration of the pool floor drain assembly of the present invention, however, provides for a variable velocity fluid flow as the fluid passes between the inlet and outlet portions of funnel shaped drain body 64. For example, the inlet or mouth of the floor drain assembly 12 is configured as an unobstructed annular or ring shaped passageway having a comparatively large diameter and a comparatively large cross sectional area. Within the neck region 68 of the funnel shaped drain body 64, the diameter of the annular or ring shaped fluid flow passageway has been reduced to a minimum distance with a resulting substantial increase in the fluid flow velocity. This increased fluid flow velocity readily crushes, folds and otherwise deforms large debris such as leaves, thereby performing a function necessary to ensure the transfer of leaves from neck section 68 through water return line 16 to pump 14 where such leaf like debris can be extracted in the pump filter basket and periodically removed by the pool user.

Figure 12:
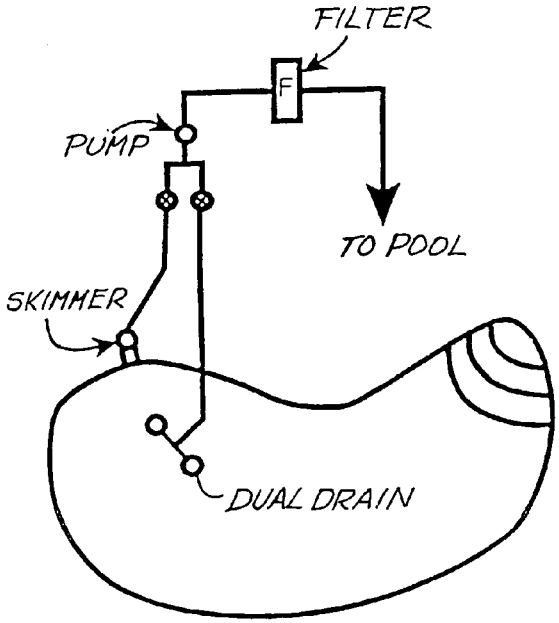
FIG. 12 (PRIOR ART)
FIG. 12 represents a schematic diagram of a pool using a prior art pool floor drain assembly.

One primary advantage of the pool floor drain assembly of the present invention is that it entirely avoids the prior art requirement for a floor drain grate assembly to filter out large size debris such as leaves. Grate assemblies are required to filter out large debris from prior art pool drain floor drain systems which are typically formed as a rectangular or circular cavity with a water return line extending either vertically downward and out of the floor drain bottom or horizontally out the side of the cavity style floor drain. In both cases, non uniform flow exists within the interior of the floor drain. Were a relatively small apertured grating not provided on the top of such prior art cavity style floor drain assemblies, large leaf like debris would be pulled into the interior of the pool drain cavity and over time would accumulate and fully obstruct the interior volume of the floor drain cavity, plug the water outlet and require activation of a secondary or alternate floor drain which, as illustrated in FIG. 12, is typically spaced at least three feet apart from the primary drain. Once that first prior art floor drain becomes clogged, the secondary drain bypass feature necessary for bather safety will have been lost. The present invention, on the other hand, by receiving and extracting from the pool floor such large leaf like debris entirely avoids the problem experienced by conventional prior art cavity style pool floor drain designs.

An additional advantage of the annular, funnel shaped fluid flow channel formed between the funnel shaped drain body 64 and fluid deflecting plug 72 is that the safety code requirement for a relatively low 1.5 foot per second fluid flow rate at the pool floor drain mouth or inlet is readily achieved due to the substantially larger fluid flow channel area at the mouth of the funnel shaped floor drain in comparison to the substantially smaller cross sectional area of the neck 68 of the drain assembly.

The domed top 76 of fluid deflecting plug 72 forms an elevated surface relative to the pool floor which performs the additional function of elevating a bather's body above the mouth of the pool floor drain assembly, a feature which may render it more difficult for a bather to inadvertently obstruct either all or part of the mouth portion of the pool floor drain assembly.

Incorporation of the vertical to horizontal fluid flow transition element 46 as an integral element of the molded drain sump 32 substantially facilitates both the initial installation of the pool floor drain assembly of the present invention as well as installation related testing and subsequent maintenance. Transition element 46 by being integrally molded can as is illustrated in FIG. 4 produce a physically compact ninety degree bend to smoothly transition from a vertical orientation to a horizontal orientation to accommodate coupling with an external horizontally oriented water return line 16 buried in the ground. The configuration of this transition element allows it to be highly compact in both the horizontal and vertical directions such that the width of transition element 46 is contained well within the overall width of the pool floor drain assembly itself. With prior art cavity style pool floor drain assemblies, a series of pipe extensions interconnected with two forty-five degree transition elements is normally required to prevent undue water flow restriction through this comparatively high velocity fluid flow conduit. The present invention readily accomplishes this ninety degree flow direction change within two inches of vertical distance whereas prior art techniques require from five to seven inches of vertical distance to accomplish that same direction change objective. For pool installations in rocky ground, caliche or other hard surfaces, this vertical distance reduction can represent a substantial savings in terms of installation cost and difficulty.

Because flow transition element 46 allows for vertical access from above through vertical oriented inlet 50 in adaptor 58, pool installation personnel can readily screw in fluid pressure testing equipment to perform leak testing before completion of pool construction. As illustrated in FIG. 4, funnel shaped drain body 64 can readily be inserted and removed because it is secured to drain sump 32 by a plurality of screws. This feature significantly facilitates both the original floor drain installation as well as subsequent maintenance and replacement of parts.

As illustrated in FIGS. 5 and 6, the bottom 34 of drain sump 32 includes an additional vertically oriented, threaded hydrostatic port 106 which is typically closed off with a threaded plug 108. Hydrostatic port 106 is designed to accommodate a hydrostatic valve 110 and a perforated french drain pipe 112 as shown in FIG. 9. Hydrostatic valves are required by codes in geographic areas such as Florida where the bottom of the pool may be installed below the local water table level. For such applications, plug 108 is removed to allow installation of a substitute hydrostatic valve 110 to perform the intended function of preventing the local water table from floating the pool out of the ground when a pool has been drained. When mouth or primary inlet 66 is obstructed, the secondary water flow path will be activated, preventing a significant pressure reduction within the secondary chamber and thereby also preventing unwanted activation of hydrostatic valve 110 with the resulting undesirable transfer of groundwater into the swimming pool. As a result, the unique configuration of the present invention effectively isolates the static relief valve or hydrostatic valve 110 from the pool suction.

As shown in FIGS. 5 and 7, the domed top 76 further serves as a separately removable cover to access the hollow or open chamber formed within the interior of fluid deflecting plug 72 to allow service access to hydrostatic plug 108 and hydrostatic valve 110. The removal of top 76 does not compromise the safety characteristics of the drain because the sidewall of base 74 of fluid deflecting plug 72 remains in place even when the domed top 76 has been removed to allow service access to hydrostatic plug 108 or to hydrostatic valve 110.

As shown in FIG. 1, one or more vent slots 114 may be provided in domed top 76. Even if vacuum relief drain 28 or alternate water return line 30 become blocked, slots 114 will provide an alternate water flow path between fluid distribution chamber 102 and the pool to prevent the pool suction line from pulling the hydrostatic valve open and feeding ground water into the pool. When the pool has been drained and ground water forces the hydrostatic valve 110 open, ground water will flow into the empty pool through slots 114 even if other portions of the floor drain inlet have been blocked.

As shown in FIG. 4, the elongated fluid flow channel may preferably be configured to include an appropriate length, spacing, and length to spacing ratio to restrict or prevent body appendages such as fingers or small hands from forming a sealing engagement with the suction inlet formed at neck 68. For example, a fluid flow channel length of about two inches or greater should accomplish that objective. Optimum performance from a safety perspective may be achieved by forming the fluid flow channel with both a sufficient length and with a tapered, narrowing channel configuration as shown in FIG. 4.

It will be apparent to those skilled in the art that the disclosed swimming pool or spa floor drain assembly may be modified in numerous ways and may assume many embodiments other than the preferred forms specifically set out and described above. For example, the transition from the relatively large diameter mouth of the floor drain assembly to the relatively small diameter neck of the funnel shaped drain body may be achieved by many other geometric configurations other than the parallel walled, double conical funnel configuration illustrated in the drawings. Specifically, the large diameter to small diameter transition could be made by means of various symmetric or asymmetric undulations transitioning from large diameter to small diameter or by a series of stepped diameter changes. In addition, it is not necessary that a constant spacing be maintained between the sidewalls forming the fluid flow pathway. In certain applications, it may be useful to vary the spacing between the sidewalls either by increasing the relative spacing, or by decreasing the relative spacing, both as a function of vertical position between the mouth and the neck of the system. Although the pool floor drain of the present invention has been described in a preferred form having a circular cross section, the present invention could readily be fabricated in an oval, rectangular or serpentine configuration without any substantial loss in the advantageous function of the present invention. For example, in a rectangular configuration, the opposed sidewalls of the funnel shared drain body and the fluid deflecting plug could be configured in a relatively parallel orientation along each rectangular sidewall segment. The pool floor drain assembly of the present invention could also be configured in the shape of a polygon such as a hexagon in addition to the other shapes described above.

The flow bypass function described above in connection with the utilization of a plurality of circumferentially spaced apart slots 98 in combination with independent fluid chamber 102 could alternatively be configured as one or more apertures disposed at one or more locations in the sidewall of the funnel shaped drain body connected directly to alternate water return line 30 rather than providing for flow between an intermediate fluid distribution chamber 102. Accordingly, it is intended by the appended claims to cover all such modifications of the invention which fall within the true spirit and scope of the invention.

We claim:

1. A drain assembly for installation in a wall of a pool comprising:

a. a drain body having an annular mouth defining an inner and an outer boundary serving as a fluid flow inlet, a spaced apart fluid flow outlet positionable below the mouth and a side wall interconnecting the mouth with the outlet and defining a fluid flow chamber, the cross sectional area of the fluid flow chamber decreasing from the mouth to the outlet;

b. a fluid deflecting plug having a comparatively large area top and defining the inner boundary of the mouth, a comparatively small area base and a side wall interconnecting the top and the base to form the plug with a cross sectional area decreasing from the top to the base;

c. a support structure for positioning the plug within the drain body such that at least a substantial portion of the sidewall of the plug is spaced apart from the sidewall of the drain body to define a fluid flow channel having a first comparatively larger cross sectional area in proximity to the mouth and a second comparatively smaller cross sectional area in proximity to the outlet to provide a lower fluid flow velocity at the mouth than at the outlet when fluid is transferred from the pool through the drain assembly; and d. a pump for drawing water through said drain body.

2. The drain assembly of claim 1 wherein the cross sectional area of the fluid flow chamber decreases as a function of the distance below the mouth and wherein the cross sectional area of the plug decreases as a function of the distance below the top.

3. The drain assembly of claim 2 wherein the sidewall of the drain body is configured with a generally conical profile.

4. The drain assembly of claim 3 wherein the sidewall of the plug is configured with a generally conical profile.

5. The drain assembly of claim 4 wherein the fluid-flow channel has a length and wherein the sidewalls of the drain body and the plug are oriented substantially parallel over at least a portion of that length.

6. The drain assembly of claim 1 wherein the cross sectional area of the fluid-flow channel is the greatest in proximity to the drain mouth and is the smallest in proximity to the drain body outlet.

7. The drain assembly of claim 1 wherein the drain body has a funnel shaped configuration.

8. The drain assembly of claim 1 includes a vertical to horizontal fluid flow transition element coupled to the outlet.

9. A pool drain assembly coupled with a water return line, said drain assembly comprising:

a. a funnel shaped drain body having a mouth serving as a fluid flow inlet, a neck serving as a fluid flow outlet and a sidewall interconnecting the mouth and neck, the neck being dimensioned to fit with and form a substantially fluid tight coupling upon connection with an inlet to the return line;

b. a fluid deflecting plug having a sidewall dimensioned to fit within the mouth of the drain body to form an annular mouth; and c. a support structure for positioning the plug within at least a part of the interior of the drain body with a fixed spacing between the plug and the sidewall of the drain body to define a fluid flow channel extending from the mouth to the neck and to define the mouth as being annular in configuration.

10. The pool drain assembly of claim 9 wherein the neck includes a vertical-to-horizontal fluid flow transition element for connection with the inlet of the return line.

11. The pool drain assembly of claim 10 wherein the fluid flow transition element includes a vertically oriented inlet and a horizontally oriented outlet.

12. The pool drain assembly of claim 11 wherein the fluid flow transition element includes an internal passageway having a substantially constant diameter.

13. The pool drain assembly of claim 11 wherein each of the mouth and the outlet includes an axis of rotation and wherein the axis of rotation of the outlet is aligned with the axis of rotation of the mouth.

14. The pool drain assembly of claim 10 wherein the drain body is formed as a substantially conical member.

15. The pool drain assembly of claim 9 wherein the plug is formed as a substantially conical member.

16. The pool drain assembly of claim 9 wherein the support structure includes a vertical support element extending laterally outward from the plug and interfacing with a complementary lateral support element extending laterally inwardly from the drain body.

17. The pool drain assembly of claim 16 wherein the support structure further includes a further vertical support element extending laterally outwardly from the plug, spanning the fluid flow channel and overlapping an upper surface of the drain body for rigidly coupling the plug to the drain body.

18. The pool drain assembly of claim 9 including coupling means for removably coupling the neck to the inlet of the return line.

19. The pool drain assembly of claim 9 wherein the plug includes a domed top.

20. A pool drain assembly comprising:

a. a funnel shaped drain body having a fluid flow inlet located at an upper end of the drain body and a fluid flow outlet located below the inlet and including a side wall extending between the inlet and outlet, the inlet having a first cross sectional area and the outlet having a second cross sectional area and wherein the first cross sectional area is greater than the second cross sectional area;

b. a fluid-deflecting plug dimensioned to fit into the inlet and having upper and lower ends and a body defined by the sidewall extending between the upper and lower ends, the body having a first cross sectional area at the upper end and a second cross sectional area at the lower end and wherein the first cross sectional area is greater than the second cross sectional area; and c. a support structure for establishing a rigid mechanical connection between the plug and the drain body to maintain a fixed spacing between the plug and the drain body to define an annular shape of the inlet and a variable velocity fluid flow channel extending between the inlet and outlet, the channel having a first cross sectional area in proximity to the inlet and a second smaller cross sectional area in proximity to the outlet to provide reduced fluid flow velocity at the inlet in comparison to the fluid flow velocity at the outlet.

21. The pool drain assembly of claim 20 wherein the plug is formed as a substantially conical member.

22. The pool drain assembly of claim 21 wherein the first cross sectional area of the plug includes a substantially circular perimeter, wherein the second cross sectional area of the plug includes a substantially circular perimeter and wherein the diameter of the first cross sectional area exceeds the diameter of the second cross sectional area.

23. The pool drain assembly of claim 21 wherein the drain body is formed as a substantially conical member.

24. The pool drain assembly of claim 20 wherein the outlet is formed as a substantially cylindrical opening.

25. The pool drain assembly of claim 20 wherein the support structure further includes a vertical support element extending laterally outwardly from the plug and interfacing with a complementary lateral support element extending laterally inwardly from the sidewall.

26. The pool drain assembly of claim 25 wherein the support structure includes a further vertical support element extending laterally outwardly from the plug, spanning the fluid flow channel and overlapping an upper surface of the drain body for rigidly coupling the plug to the drain body.

27. The pool drain assembly of claim 26 wherein the sidewall includes first and second spaced apart, vertically oriented recesses and wherein the further vertical support element includes first and second spaced apart, downwardly extending pegs positioned and dimensioned to mate with the first and second recesses.

28. The swimming pool floor drain assembly of claim 27 further including first and second fasteners for rigidly securing the first and second pegs to the first and second recesses.

* * * * *